US007621484B2

(12) United States Patent
Wingert

(10) Patent No.: US 7,621,484 B2
(45) Date of Patent: Nov. 24, 2009

(54) ROTOR KITE

(76) Inventor: Stephen Wingert, 1406 Morgan Station Rd., Woodbine, MD (US) 21797

( * ) Notice: Subject to any disclaimer, the term of this patent is extended or adjusted under 35 U.S.C. 154(b) by 315 days.

(21) Appl. No.: 11/779,921

(22) Filed: Jul. 19, 2007

(65) Prior Publication Data

US 2009/0020649 A1 Jan. 22, 2009

(51) Int. Cl.
*B64C 31/06* (2006.01)

(52) U.S. Cl. ..... 244/153 A; 244/153 R

(58) Field of Classification Search ..... 244/153 A, 244/153 R; D21/445–447
See application file for complete search history.

(56) References Cited

U.S. PATENT DOCUMENTS 2,107,808 A * 2/1938 Van Ittersum ..... 244/153 A
4,121,794 A 10/1978 Lemelson
4,243,190 A 1/1981 Sams
4,779,825 A 10/1988 Sams
4,790,498 A * 12/1988 Jeffrey ..... 244/153 A
5,954,297 A 9/1999 Bukur

* cited by examiner

*Primary Examiner*—Tien Dinh
(74) *Attorney, Agent, or Firm*—Lawrence E. Laubscher, Jr.

(57) ABSTRACT

A rotor kite is characterized by a stabilizer bar connected between the wing and stabilizer ring components of the kite to maintain the wing and the stabilizer ring in a perpendicular orientation with respect to each other during flight. The stabilizer bar is connected at its ends with the inner edge of the annular stabilizer ring so that the bar extends across the inner diameter of the ring. The wing is connected with the bar at multiple locations within the stabilizer ring, with the bar extending normal to the longitudinal axis of the wing. When the kite is released, the wind rotates the wing which in turn lifts the kite into the air. The stabilizer acts as a rudder to maintain the wing perpendicular to the wind direction.

10 Claims, 3 Drawing Sheets

ROTOR KITE

BACKGROUND OF THE INVENTION

The present invention relates to a rotor kite. Such kites generally include a rotating wing or sail and a stabilizer or keel. The stabilizer is perpendicular to the wing and generally bisects the wing. Some designs utilize flat wings while others utilize wings having a curved configuration. Rotor kites achieve their lift as a result of rotation of the wing in the same direction as the prevailing wind. The lift generated in such a manner is the result of the Magnus Effect.

BRIEF DESCRIPTION OF THE PRIOR ART

Rotor kites are well-known in the patented prior art as evidenced by the Sams U.S. Pat. Nos. 4,243,190 and 4,779,825 and the Bukur U.S. Pat. No. 5,954,297. The Sams patents for example disclose rotor kites utilizing a wing and a ring-shaped stabilizer. The wing includes a frame and a covering for the frame formed of a thin plastic film. The stabilizer also includes a covering. An axle rod passes through the wing and includes loops at the ends for connection with a bridle. During operation, the wing begins to rotate and the stabilizer swings about a hinge axis to a position normal to the plane of the wing. The Bukur patent discloses a rotary flyer including a wing and a disk. In order to maintain a perpendicular orientation of the disk, two stabilizing elements are removably connected between the wing and the disk.

Rotor kites that allow for the separation of the wing from the stabilizer or folding of the wing against the stabilizer require a special connector between the wing and stabilizer in order to maintain a perpendicular arrangement between the two. The stabilizers of Bukur are inefficient and awkward. Other connection devices such as adhesive tape and guy wires have also proven to be unsatisfactory. With improperly constructed or connected stabilizers, the rotary kites of the prior art tend to dive toward the ground in high wind conditions. In addition, flattening of the wing and stabilizer while launching the kite make it difficult to render the kite airborne without a second person to hold the kite. Furthermore, flattening of the wing and stabilizer in flight prevents the wing from rotating and thus the kite falls to the ground. Rotor kites having wing framing formed of flexible rods also suffer from poor performance. As wind speed increases, the wings flex laterally, thereby altering the shape of the wings.

The present invention was developed in order to overcome these and other drawbacks of the prior rotor kites by providing an improved connection between the wing and the stabilizer and an improved wing design.

SUMMARY OF THE INVENTION

The rotor kite according to the invention includes an annular stabilizer ring having a stabilizer rod extending across the inner diameter thereof. An elongated wing is connected with the stabilizer rod and arranged within the inner perimeter of the stabilizer ring. The wing has a longitudinal axis which extends perpendicular to the stabilizer rod. An axle is connected with the wing along the longitudinal wing axis so that the wing is allowed to rotate with the axle about the axis. The axle is also connected with the stabilizer rod at a midpoint thereof. When a yoke or bridle is connected with the ends of the axle, the wing is rotated by wind directed against the wing to lift the kite into the air. The stabilizer ring rotates with the wing to maintain the wing in a position generally normal to the direction of the wind, with the stabilizer rod retaining the stabilizer ring in a plane normal to the axle.

Both the wing and the stabilizer ring include a frame formed of flexible rods with a layer of fabric material connected therewith. The wing frame defines the perimeter of the wing and the stabilizer frame comprises a pair of concentric rings.

The wing frame is formed of composite materials. The leading edges of the wing are formed from larger stiff rods or synthetic plastic connectors. The remainder of the wing frame is formed from flexible rods that are connected with the leading edge connector. The leading edges of the wing are also connected with the stabilizer rod. The stabilizer rod is connected with the inner ring of the stabilizer ring in order to maintain the normal arrangement of the stabilizer ring relative to the wing. The ends of the wing have synthetic plastic connectors which receive the rods of the wing frame and the axle. Each end connector also includes a bearing which allows the wing to rotate about its longitudinal axis. The wing can be removed from the stabilizer or rotated about the stabilizer rod for transport and storage. In addition, wings of various shape and strength can be connected to the stabilizer ring. Providing wings of various aerodynamic quality and weight which are interchangeably connected with the stabilizer ring provides rotor configurations that optimize the kite's performance in prevailing wind conditions.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
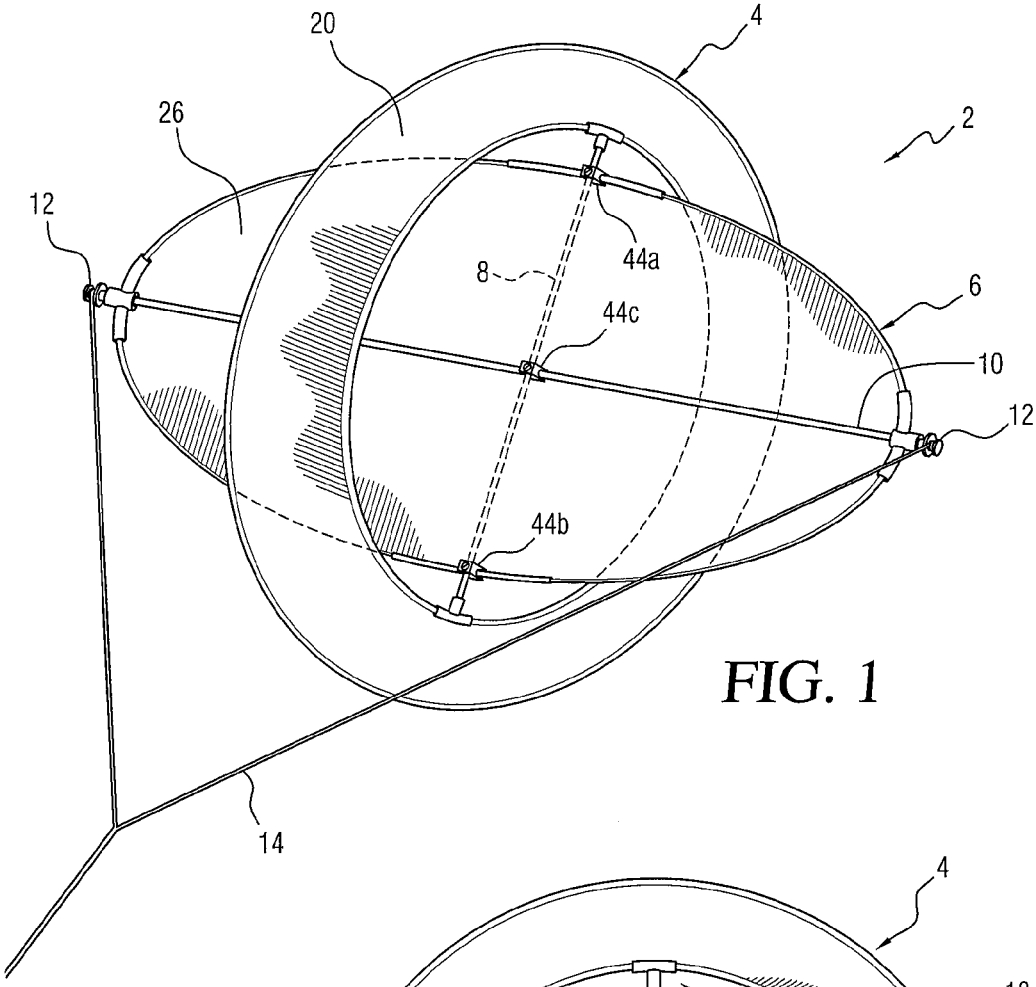
FIG. 1 is a perspective view of the rotor kite according to the invention.
Figure 2:
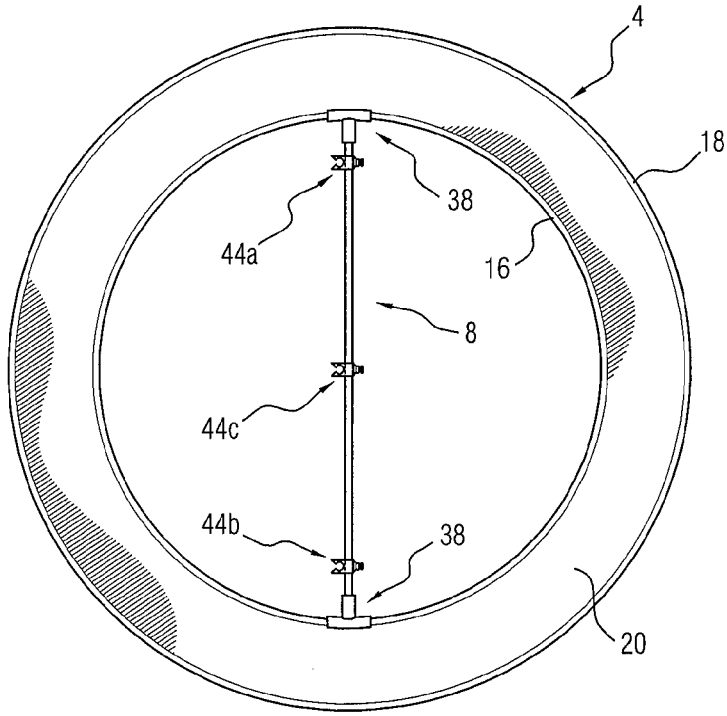
FIG. 2 is a partial sectional view of the stabilizer ring of the rotor kite shown in FIG. 1.

Referring first to FIGS. 1 and 2, the preferred embodiment of the rotor kite 2 according to the invention will be described. The kite includes two main components: an annular stabilizer ring 4 and an elongated wing 6. A stabilizer rod 8 is connected with the inner portion of the stabilizer ring and extends across the inner diameter of the ring. The wing has a longitudinal axis. At the mid-section of the wing relative to its longitudinal axis, the wing is connected with the stabilizer rod in a manner to be described in greater detail below. An axle 10 is connected with the wing, such as via a pocket within the wing, and extends along the wing longitudinal axis. At the ends of the axle are bearings 12, such as roller bearings, which connect the axle with a yoke or bridle 14 so that the axle is allowed to rotate. In operation, when the rotor kite is released, wind catches the wing and causes it to rotate. The stabilizer ring rotates with the wing while being maintained in a plane normal to the longitudinal axis of the wing by the stabilizer rod. Rotation of the wing causes the kite to be lifted into the air, and the stabilizer ring acts as a rudder to maintain the kite and the wing in a position normal to the direction of the wind.

Figure 3:
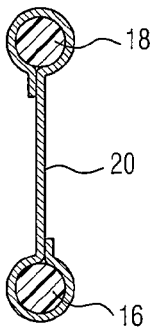
FIG. 3 is a sectional view of the stabilizer ring of the rotor kite of FIG. 1.

Referring to FIG. 3, the stabilizer ring 4 includes a frame formed from an inner ring 16 and an outer ring 16 which are arranged concentrically. A layer of fabric material 20 such as nylon is connected with the frame by stitching, sewn webbing or other connection as is known in the art. The rings preferably comprise rods that are formed of any suitable rigid material such as fiberglass, carbon fiber, or synthetic plastic. While the rings are preferably rigid in the sense that they retain their shape, they also have a certain amount of flex.

Figure 4:
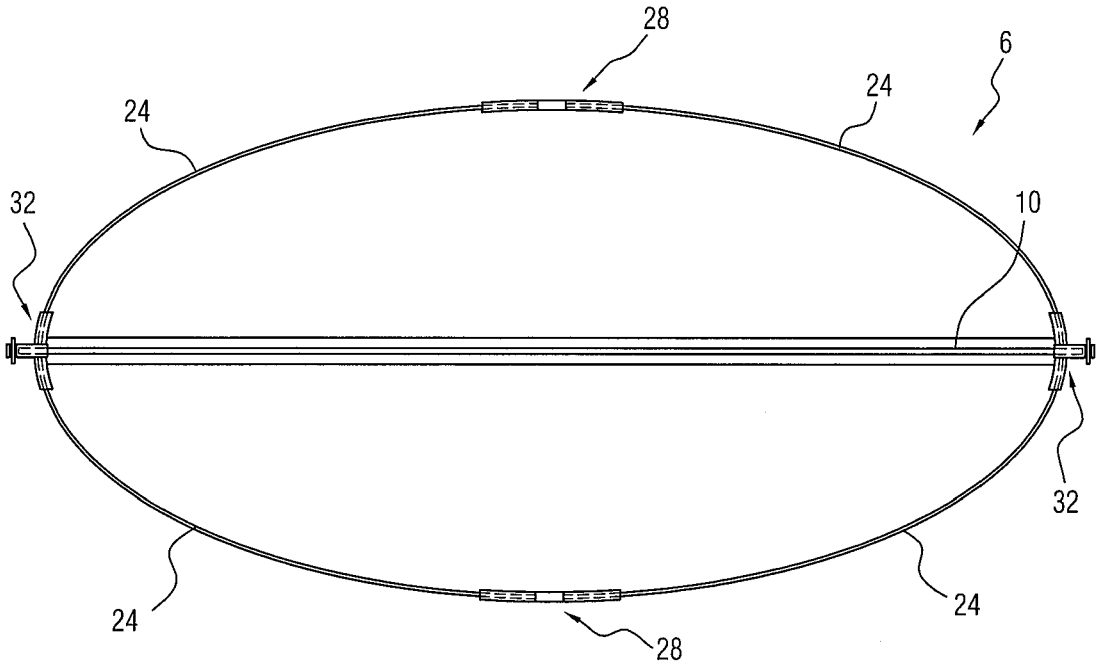
FIG. 4 is a partial sectional view of the stabilizer ring of the wing of the rotor kite of FIG. 1.
Figure 5:
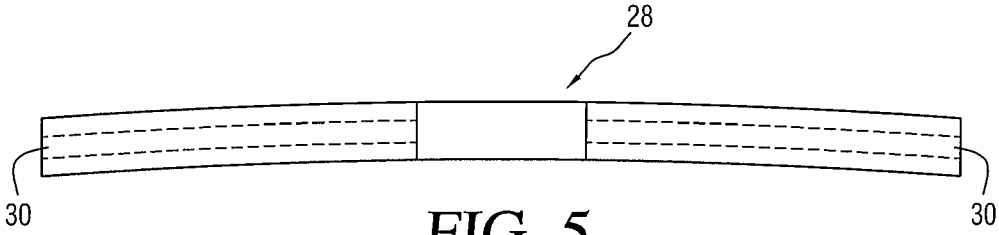
FIG. 5 is a plan view of a leading edge connector of the wing frame according to the invention.
Figure 6:
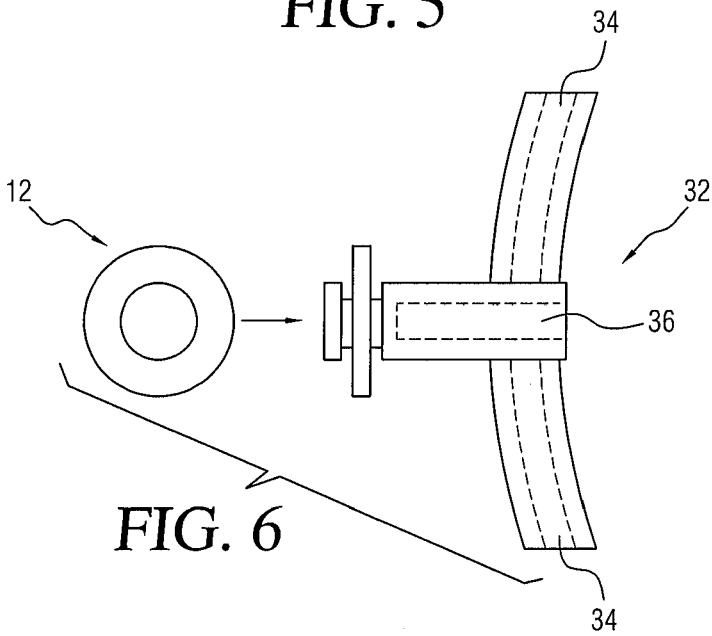
FIG. 6 is a side plan view of an end connector for the wing frame according to the invention.

Referring now to FIG. 4, the wing will be described in greater detail. It is formed in the same manner as the stabilizer ring in that an outer frame 22 formed of fiberglass rods 24 or the like has a layer of fabric material 26 connected therewith. Connectors 28 at the leading edge of the frame connect the ends of the rods. As shown in FIG. 5, each connector includes openings 30 in the opposite ends thereof to receive the end of the rods for a snug-fit connection in an end-to-end configuration. At the ends of the wing, end connectors 32 are provided. The end connectors contain openings 34 in the ends thereof for receiving the ends of the rods and a further opening 36 for receiving the end of the axle. A bearing 12 is provided on each connector 32 to allow the wing to rotate about the axle. It will be appreciated that the fabric for the wing and stabilizer frame may be formed in different colors to make the kite more attractive.

Figure 7:
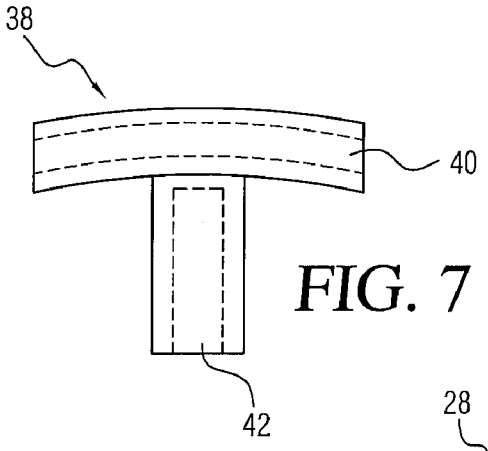
FIG. 7 is a side plan view of a device for connecting the inner ring of the stabilizer ring with the stabilizer rod.

The connection of the stabilizer rod 8 to the inner ring 14 of the stabilizer ring will be described with reference to FIGS. 2 and 7. Like the framework for the wing and stabilizer ring, the stabilizer rod is preferably formed of a fiberglass, carbon fiber or synthetic plastic material. Opposed synthetic plastic connectors 38 are provided for the stabilizer ring and have a T-shaped configuration. Each connector contains a through-channel 40 for receiving the inner ring 16 of the stabilizer. The connectors also contain an opening 42 for receiving the end of the stabilizer rod 8 via a snug-fit connection. This arrangement allows the rod to be removably connected with the stabilizer ring.

Figure 8:
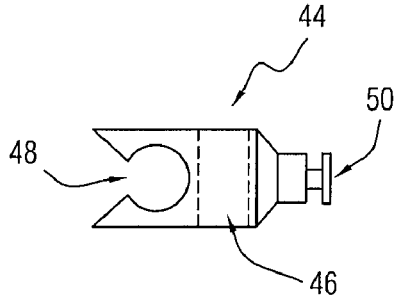
FIG. 8 is a plan view of a device for connecting the stabilizer rod with the wing.

The connection of the stabilizer rod 8 to the wing is via connectors 44, one of which is shown in FIG. 8. The connector includes a first through-opening 46 and a second through-opening 48 which extend in perpendicular directions in the connector. The first through-opening 46 is adapted to receive the stabilizer rod. A screw 50 can be tightened against the stabilizer rod to fix the connector in position on the rod. The second through-opening 48 receives either the frame of the wing or the axle via a snap-fit connection. More particularly, the upper and lower connectors 44*a* and 44*b* shown in FIG. 2 are for connection with the frame of the wing as shown in FIG. 1, while the center connector 44*c* is for connection with the axle. By loosening the screws 50, the wing can be rotated about the stabilizer rod and folded against the stabilizer ring for storage or transport.

Figure 9A:
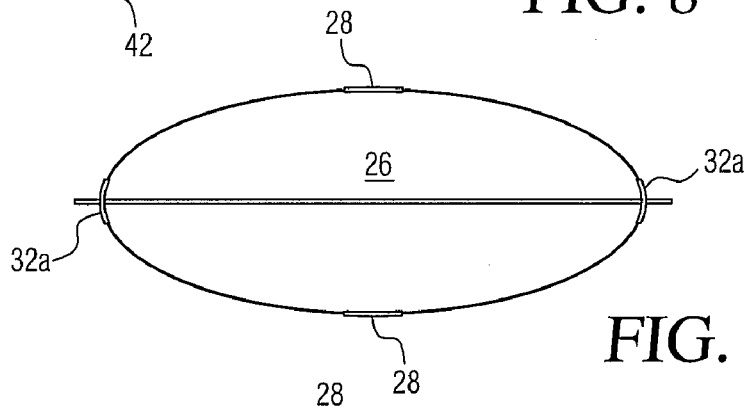
FIGS. 9*a*-9*d* are front plan views of various configurations of the wing according to the invention.
Figure 9B:
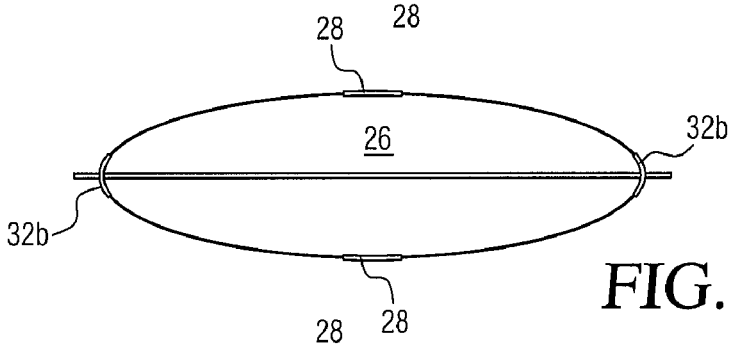
Figure 9C:
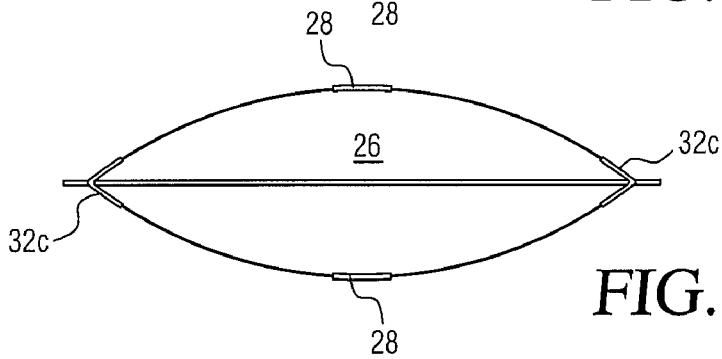
Figure 9D:
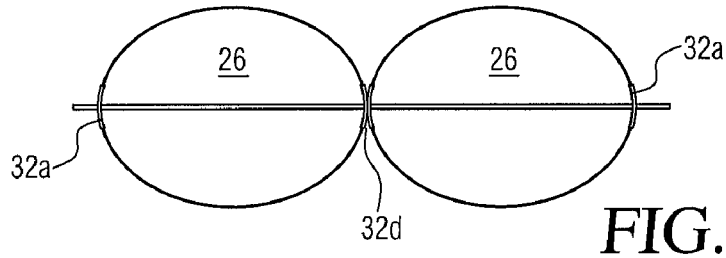

The wing can have different configurations as shown in FIGS. 9*a*-9*d*. The configurations are altered by modifying the frame of each wing. This is done by providing end connectors 32 of different configurations. The end connectors are designed as plug and fit connectors for the rods of the wing frame. In FIGS. 9*a* and 9*d*, the end connectors 32*a* have a relatively small curvature, so the wing has a wide oval configuration. In FIG. 9*b*, the end connectors 32*b* have a more pronounced curvature which results in a narrower oval configuration for the wing. In FIG. 9*c*, the end connectors 32*c* have a V-shaped configuration so that the wing has an eye configuration. Finally, in FIG. 9*d*, an intermediate connector 32*d* is provided so that a dual wing configuration is provided.

The wing leading edge connectors 28 are provided to strengthen and shape the wing. The connectors are preferably made of synthetic plastic material and can be constructed in various lengths or weights so that differently sized members can be connected with the wing depending on the wind conditions. In stronger wind, longer and or heavier connectors are desired since they help to stabilize the wing. Where reinforcements are provided, they may also be threaded through the openings of the connectors 26 (with the frame) for connection with the stabilizer rod. A wing frame without the leading edge connectors 28 will bend under high wind conditions which leads to instability of the kite and cause the kite to dive toward the ground.

The frames for the wing and stabilizer ring and the connections between the stabilizer rod, the wing and the stabilizer ring are such that the kite can easily be assembled for use or disassembled for storage or transport. When assembled, the connectors and stabilizer bar fix the wing and stabilizer ring in a perpendicular arrangement with respect to one another. Moreover, different size and shaped wings can be constructed and connected with the stabilizer ring. This allows the configuration of the kite to be determined by the user in accordance with the wind conditions.

While the preferred forms and embodiments of the invention have been illustrated and described, it will be apparent to those of ordinary skill in the art that various changes and modifications may be made without deviating from the inventive concepts set forth above.

What is claimed is:

1. A rotor kite, comprising (a) an annular stabilizer ring;

(b) a stabilizer rod connected at its ends with said stabilizer ring, said stabilizer rod extending across the inner diameter of said stabilizer ring;

(c) an elongated wing connected with said stabilizer rod, said wing being arranged within the inner perimeter of said stabilizer ring and having a longitudinal axis which is arranged perpendicular to said stabilizer rod; and (d) an axle connected with said wing along the longitudinal axis and connected with said stabilizer rod at a midpoint thereof, whereby when a yoke is connected with the ends of the axle, said axle and wing are rotated by the wind to lift the kite into the air, said stabilizer ring rotating with said wing to maintain said wing in a position generally normal to the direction of the wind with said stabilizer rod maintaining said stabilizer ring in a plane normal to said axle.

2. A rotor kite as defined in claim 1, wherein said wing includes an outer wing frame and a fabric material connected with said frame.

3. A rotor kite as defined in claim 2, wherein said wing frame includes leading edge connectors along a leading edge of the wing in a central region thereof.

4. A rotor kite as defined in claim 3, wherein said leading edge connectors are further connected with said stabilizer rod.

5. A rotor kite as defined in claim 3, wherein said wing frame includes end connectors at the longitudinal ends of said wing, said end connectors connecting said wing frame with said axle.

6. A rotor kite as defined in claim 5, wherein said end connectors have different configurations in accordance with the planar configuration of said wing.

7. A rotor kite as defined in claim 1, and further comprising bearings connected with the ends of said axle to allow said axle to rotate relative to the yoke.

8. A rotor kite as defined in claim 1, wherein said stabilizer ring comprises a stabilizer frame of concentric rings with a layer of fabric material extending therebetween.

9. A rotor kite as defined in claim 8, wherein said stabilizer rod is connected with an inner ring of said stabilizer frame.

10. A rotor kite as defined in claim 9, wherein said stabilizer rod is further connected with an outer ring of said stabilizer frame.

* * * * *